US005438382A

United States Patent [19]

Morita

[11] Patent Number: 5,438,382

[45] Date of Patent: Aug. 1, 1995

[54] PHOTOGRAPHIC PROCESSING APPARATUS

[75] Inventor: Satoshi Morita, Kanagawa, Japan

[73] Assignee: Fuji Photo Film Co., Ltd., Kanagawa, Japan

[21] Appl. No.: 168,363

[22] Filed: Dec. 17, 1993

[30] Foreign Application Priority Data

Dec. 18, 1992 [JP] Japan ..... 4-354918

[51] Int. Cl.[6] ..... G03D 13/00; G03D 3/08

[52] U.S. Cl. ..... 354/298; 354/321

[58] Field of Search ..... 354/297, 319, 320–324, 354/340, 298

[56] References Cited

U.S. PATENT DOCUMENTS 4,145,126 3/1979 Bagby et al. ..... 352/74

5,231,439 7/1993 Takahashi et al. ..... 354/320 X R

FOREIGN PATENT DOCUMENTS 58-107540 6/1983 Japan .

*Primary Examiner*—D. Rutledge

*Attorney, Agent, or Firm*—Sughrue, Mion, Zinn, Macpeak & Seas

[57] ABSTRACT

A photographic processing apparatus for processing an exposed film accommodated in a film accommodating element and a photographic printing paper. The film is subjected to the processing while the film is drawn out of the accommodating element and stored again. A transfer element moves the film accommodating element from a conveyance start position drawing out the film to a conveyance end position storing again the film. A conveying passage changing system changes a conveying passage of the film. The conveying passage changing system includes an inverting element for swapping a front end of the film and a rear end of the film during conveying.

8 Claims, 9 Drawing Sheets

PHOTOGRAPHIC PROCESSING APPARATUS

BACKGROUND OF THE INVENTION

This invention relates to a photographic processing apparatus having a function of developing images on negative films, or a function of exposing the images onto a photographic printing paper, or a function of developing the photographic printing paper, or those functions.

There are available photographic processing apparatuses having a function of developing images of a negative film (hereinafter referred to as "a film developing function", when applicable), or a function of exposing images of the negative film onto a photographic printing paper (hereinafter referred to as "paper"), or a function of developing latent images formed on the paper (hereinafter referred to as "a paper developing function", when applicable). In addition, recently there has been provided a photographic processing apparatus which has all of the above-described functions in one body, thus being able to perform all photographic processing operations successively.

In an ordinary photographic processing apparatus, an exposed negative film is drawn out of the cartridge, and the film thus drawn out is immersed in processing tanks containing processing solutions successively so that the film is subjected to development, fixation, washing, and drying. On the other hand, in the photographic processing apparatus in one body as the all-round type able to perform all the photographic processing operations, following the above successive processing, prints are obtained as follows: The frames of the negative film are successively exposed beginning with the first one to form the corresponding latent images on a paper, and the paper thus processed is immersed in the processing tanks successively, and then the paper is subjected to development, fixation, washing, and drying so as to obtain the images on the paper.

The prints thus obtained are stacked in the print storing section. In this operation, the top of the prints thus stacked is a print corresponding to the last frame of the negative film, because the frames of the negative film are exposed beginning with the first frame as was described above.

That is, the order of the prints thus stacked is opposite to that of the frame numbers, which makes it rather troublesome to collate the frames of the negative film with the resultant prints.

On the other hand, the negative film after exposing the images onto the papers is put back into the cartridge. Hence, the cartridge is handled as follows: At the first processing station on the photographic processing line, the film is pulled out of the cartridge, and then the cartridge is moved to the last station, where it receives the negative film processed. When it is required to perform the photographic printing operation again, it is necessary to pull the negative film out of the cartridge again. In this case, in order to perform the photographic processing operations smoothly, the negative film should be pulled out of the cartridge in such a manner that the first frame comes out first. In order to meet this requirement, the negative film must be wound back into the cartridge beginning with its rear end corresponding to the last frame; that is, the negative film must be wound as it was.

In the ordinary photographic processing apparatus having only the negative film developing function or the negative film exposing function, similarly it is desirable that the negative film is wound back into the cartridge so that the film can be pulled out of the cartridge in such a manner that the front end thereof corresponding the first frame comes out first.

In the all-round type photographic processing apparatus in one body, in addition to processing a negative film before development is an already developed film is again processed to obtain prints. In this case, since the negative film is subjected to a development already. That is, it must be forwarded to the negative film exposing section directly without immersing in the developing tank. In the ordinary photographic processing apparatus having only the film developing function or the negative film exposing function, the film conveying path must be determined according to whether or not the film in the cartridge has been developed.

SUMMARY OF THE INVENTION

This invention aims at eliminating the above-mentioned problems. It is an object of the invention to provide a photographic processing apparatus in which a negative film pulled out of the cartridge is put back in the cartridge as it was, and the conveying path for the film is changed according to whether or not it has been developed.

The foregoing object has been achieved by the provision of the following means:

The first means is a photographic processing apparatus in which a photographing film pulled out of film accommodating means set at a conveyance start position is photographically processed, and the film accommodating means is moved to a conveyance end position, where the film thus photographically processed is put back in the film accommodating means, in which, film inverting means for swapping the front and rear ends of the film is arranged between the conveyance start position and the conveyance end position, so that the film thus photographically processed is put back in the film accommodating means at the conveyance end position beginning with the rear end thereof.

The second means is a photographic processing apparatus in which a photographing film pulled out of film accommodating means set at a conveyance start position is photographically processed with film developing means and with exposing means for applying light through a developed film onto a photographic paper, and the film accommodating means is moved to a conveyance end position, where the film thus photo-graphically processed is put back in the film accommodating means beginning with the rear end thereof, in which detecting means detects whether or not the film in the film accommodating means set at the conveyance start position has been developed, and branching means leads, when the detecting means detects that the film in the film accommodating means has been developed, the film directly to the exposing process, and when the film in the film accommodating means has not been developed, the film directly to the developing process.

The third means is a photographic processing apparatus comprising film developing means for developing a photographing film, in which detecting means detects whether or not the film in the film accommodating means set at a conveyance start position has been developed, and removing means removes, when the detecting means detects that the film in the film accommodating means has been developed, the film out of the apparatus.

The fourth means is a photographic processing apparatus comprising exposing means for applying light through a developed film onto a photographic paper, in which detecting means detects whether or not the film in the film accommodating means set at a conveyance start position has been developed, and removing means removes, when the detecting means determines that the film in the film accommodating means has not been developed, the film out of the apparatus.

With the above-described means of the invention, the film pulled out of the film accommodating means set at the conveyance start position is developed and exposed, and thereafter put back into the film accommodating means moved to the conveyance end position. In order to put back the film into the film accommodating means as it was; that is, in order that at the conveyance end position, the film is accommodated in the film accommodating means in the same manner as it has been at the conveyance start position, the inverting means is provided to invert the film which has been pulled out of the film accommodating means beginning with the front end, whereby the film is put back in the film accommodating means beginning with the rear end.

The inverting means may be provided at either the conveyance start position or the conveyance end position. If, in the case where the film should be developed, the inverting means is provided before the developing means, then the inverting means must be of dark room type. If the inverting section is provided after the exposing means, then the frames of the film are exposed successively beginning with the first frame. Therefore, the resultant prints are stacked one on another with the print surface corresponding to the first frame upside or downside.

The inverting means has a box for accommodating the film, an inlet through which the film is taken into the box, and an outlet through which the film is taken out of the box. The film is taken into the box beginning with its front end when the latter arrives at the inlet, and it is pulled out of the box through the outlet beginning with the rear end, as a result of which the front and rear ends of the film are swapped.

The inverting means has a reel winding mechanism for winding the film. In this case, the film wound beginning with the front end is pulled out beginning with the rear end, so that the front and rear ends of the film are swapped (cf. Japanese Patent Application Laid-Open No. sho. 58-107540.

In the case where the film in the film accommodating means is the developed one, the branching means provides a suitable conveying path for the film so that the latter is conveyed directly to the exposing means (without passing through the developing means).

The branching means is provided before the developing means. In order to perform a series of photographic processing operations, the photographic processing device has moving means for moving the film accommodating means from the conveyance start position to the conveyance end position. In the case where the developed film is given to the apparatus, the film accommodating means is moved from the conveyance start position to the conveyance end position, where the film is pulled out and conveyed to the exposing means. In the case where the moving means is used as the branching means in this manner, the film pulled out at the conveyance start position is switched back so as to be put back in the film accommodating means. And while being switched back, the film is exposed to form latent images on the photographic paper. In this case, the frames of the film are exposed beginning with the last one, and therefore the resultant prints are stacked in the normal order.

On the other hand, the photographic processing apparatus having the developing means for developing a photographing film, or the exposing means for applying light through a developed film onto a photographic paper has the inverting means so that the film is put back into the film accommodating means beginning with the rear end, and the removing means so that a conveying path is determined for the film according to whether or not the film in the film accommodating means has been developed. That is, in the photographic processing apparatus having the developing means only, the film is handled as follows: When it is detected that the film in the film accommodating means is the developed one, the film is not pulled out of it; that is, the film accommodating means is removed from the apparatus as it is. When, in the photographic processing apparatus having the exposing means, it is detected that the film in the film accommodating means is not developed yet, the film is not pulled out of it, and the film accommodating means is removed from the apparatus as it is.

BRIEF DESCRIPTION OF THE DRAWING(S)

Figure 8A:
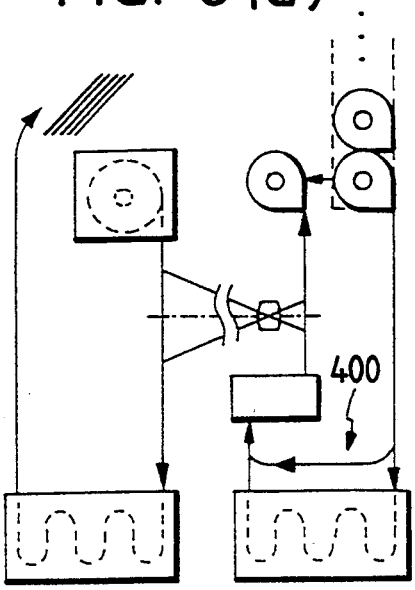
Figure 8B:
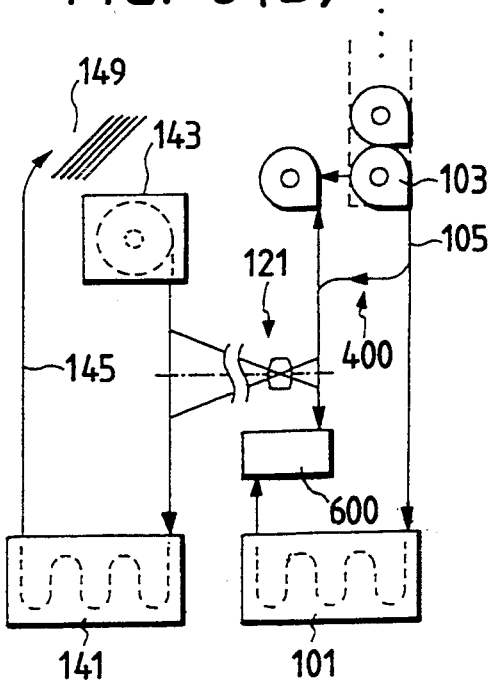
Figure 8C:
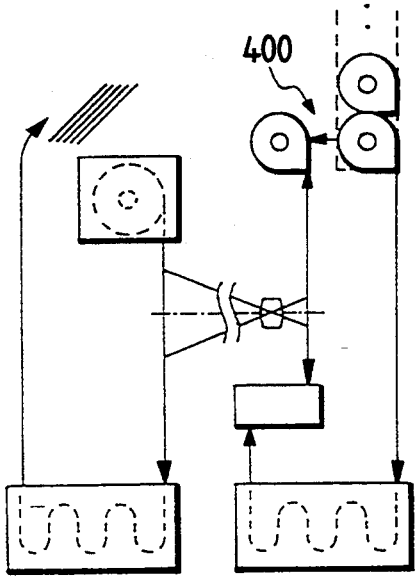
Figure 9A:
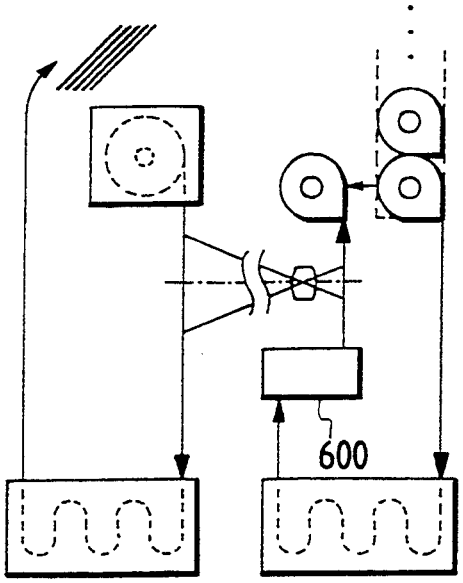
Figure 9B:
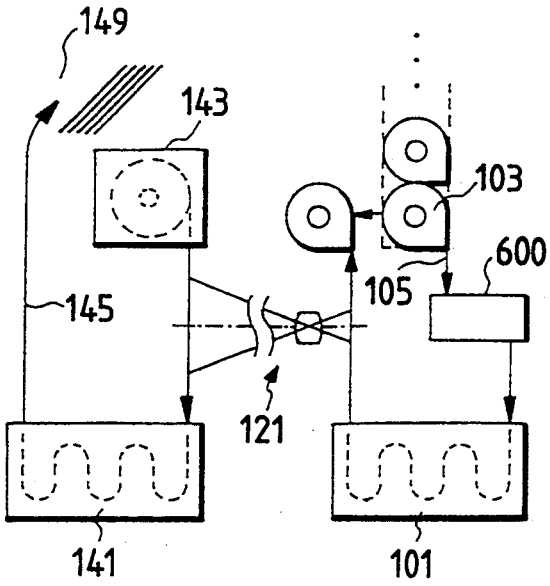
Figure 9C:
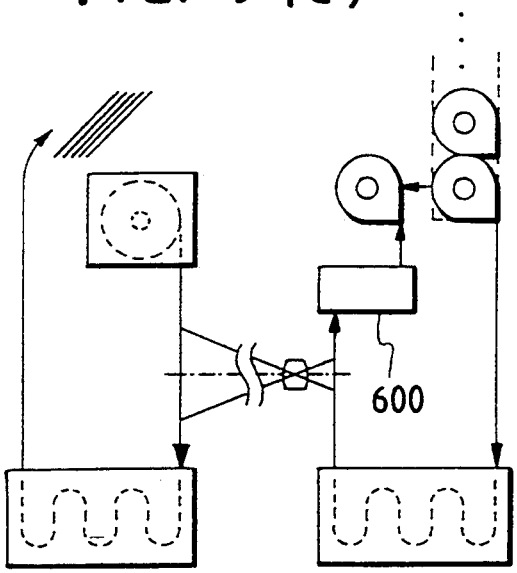
Figure 9D:
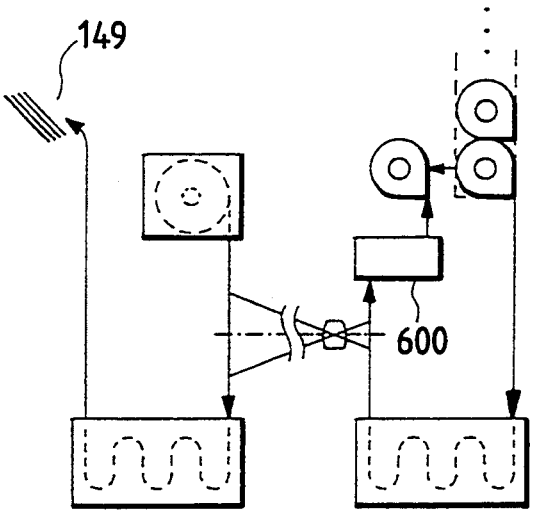

FIGS. 8(*a*), 8(*b*) and 8(*c*) are explanatory diagrams showing arrangements of the bypass section 400 of respective embodiments of the invention.

FIGS. 9(*a*), 9(*b*), 9(*c*) and 9(*d*) are explanatory diagrams showing arrangements of the inverting section 600 of respective embodiments of the invention.

Figure 10:
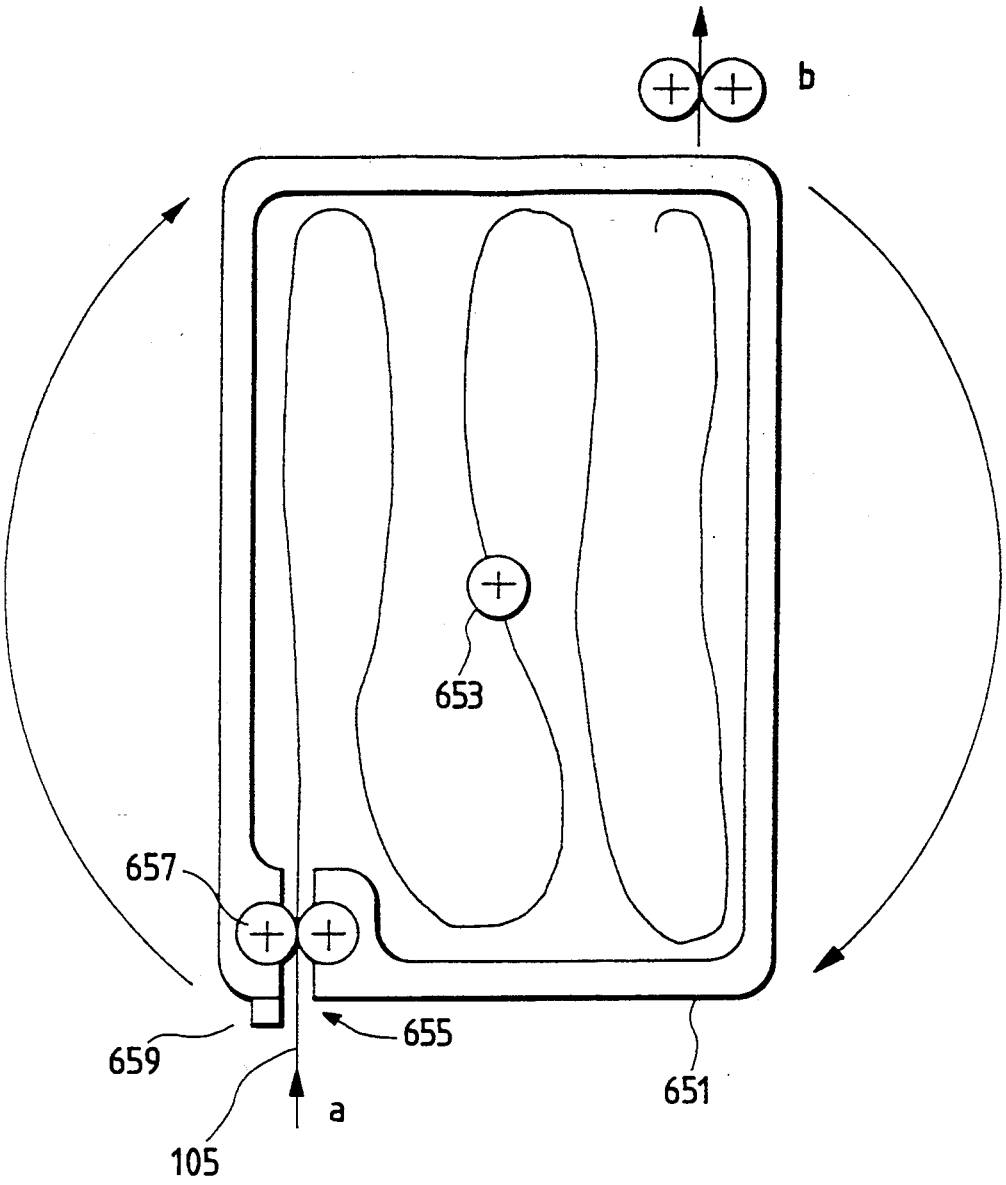

FIG. 10 is a front view showing an inverting section 600 of another embodiment of the invention.

DETAIL DESCRIPTION OF THE PREFERRED EMBODIMENTS

A preferred embodiment of this invention will be described with reference to the accompanying drawings.

Figure 1:
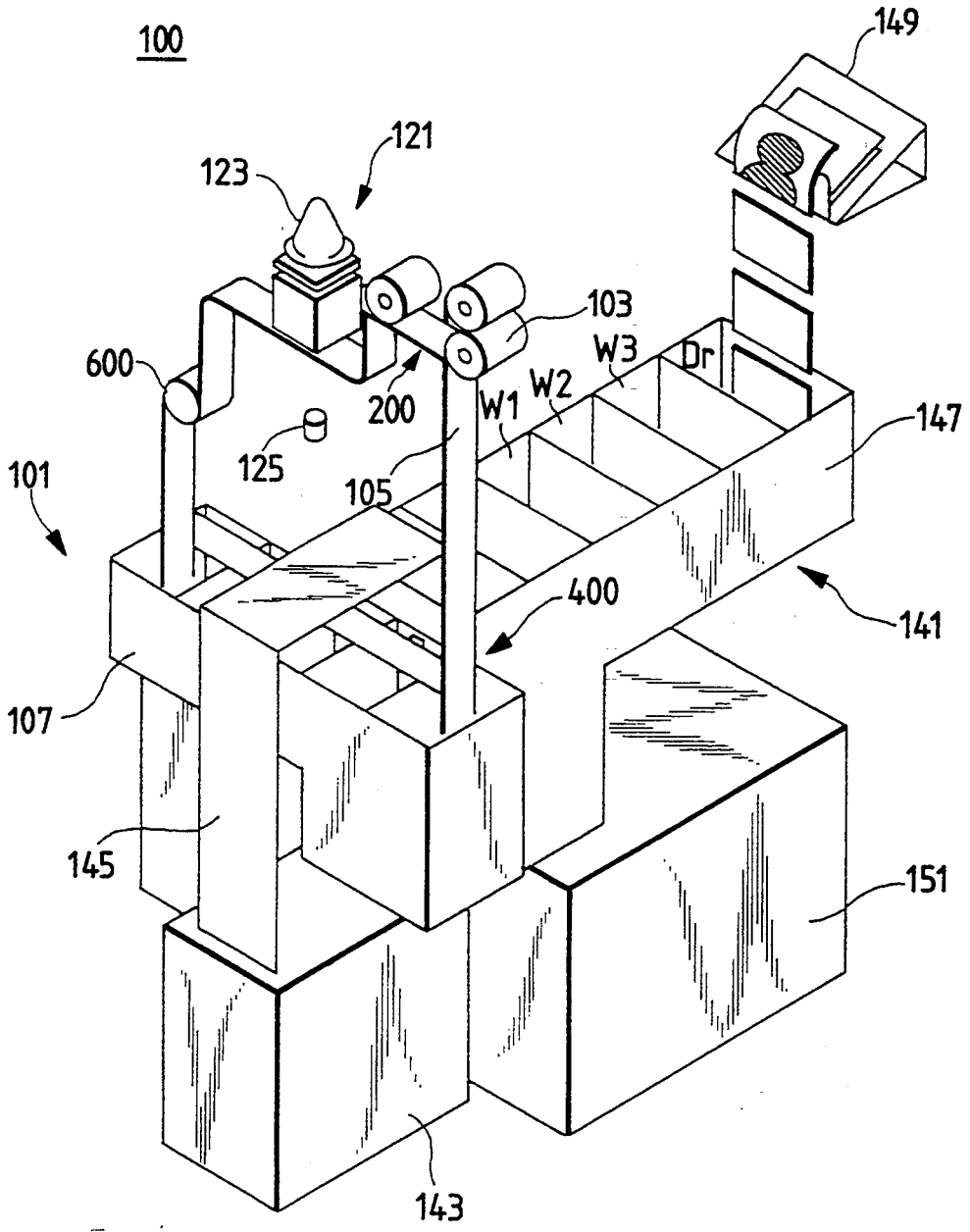
FIG. 1 is a diagram outlining the arrangement of a photographic processing apparatus, which constitutes an embodiment of this invention.

FIG. 1 is a diagram outlining the arrangement of a photographic processing apparatus 100, the embodiment of the invention. The photographic processing apparatus 100 comprises: a film developing section 101; a negative film exposing section 121; and a paper developing section 141.

The film developing section 101 comprises: a processing tank 107 containing various processing solutions in which a photographing film 105 pulled out of a cartridge 103 is immersed; an inverting section 600 for swapping the front and rear ends of the film 105 before the negative film exposing section 121; a cartridge transferring section 200 for conveying the cartridge 103 from a conveyance start position to a conveyance end position to put the film back in the cartridge 103; and a bypass section 400 which operates to switch film conveying paths so that, when the film pulled out of the cartridge is not developed yet, the film is immersed in the processing solutions in the processing tank 107, and when the film is the developed one, it is not immersed in the processing solutions.

The negative film exposing section 121 comprises: a light source section 123 adapted to apply light to the negative film 105 from upward; and an optical section 125 including a lens and a filter, the optical section 125 being interposed between the negative film 105 and a photographic paper 145.

The paper developing section 141 comprises: a magazine in which a roll of photographic paper is set; a processing tank 147 containing various processing solutions in which the paper 145 pulled out of the magazine 143 is immersed after being exposed through the film; and a print storing section 149, in which prints are stored successively which are formed by cutting the photographic paper to predetermined size which has been developed passing through the processing tank 147.

A disposing tank 151 is provided to supplement or discharge the processing solutions in the processing tanks 107 and 147. The film 105 and the paper 145 are conveyed by pairs of conveying rollers (not shown) arranged at predetermined positions.

Figure 2:
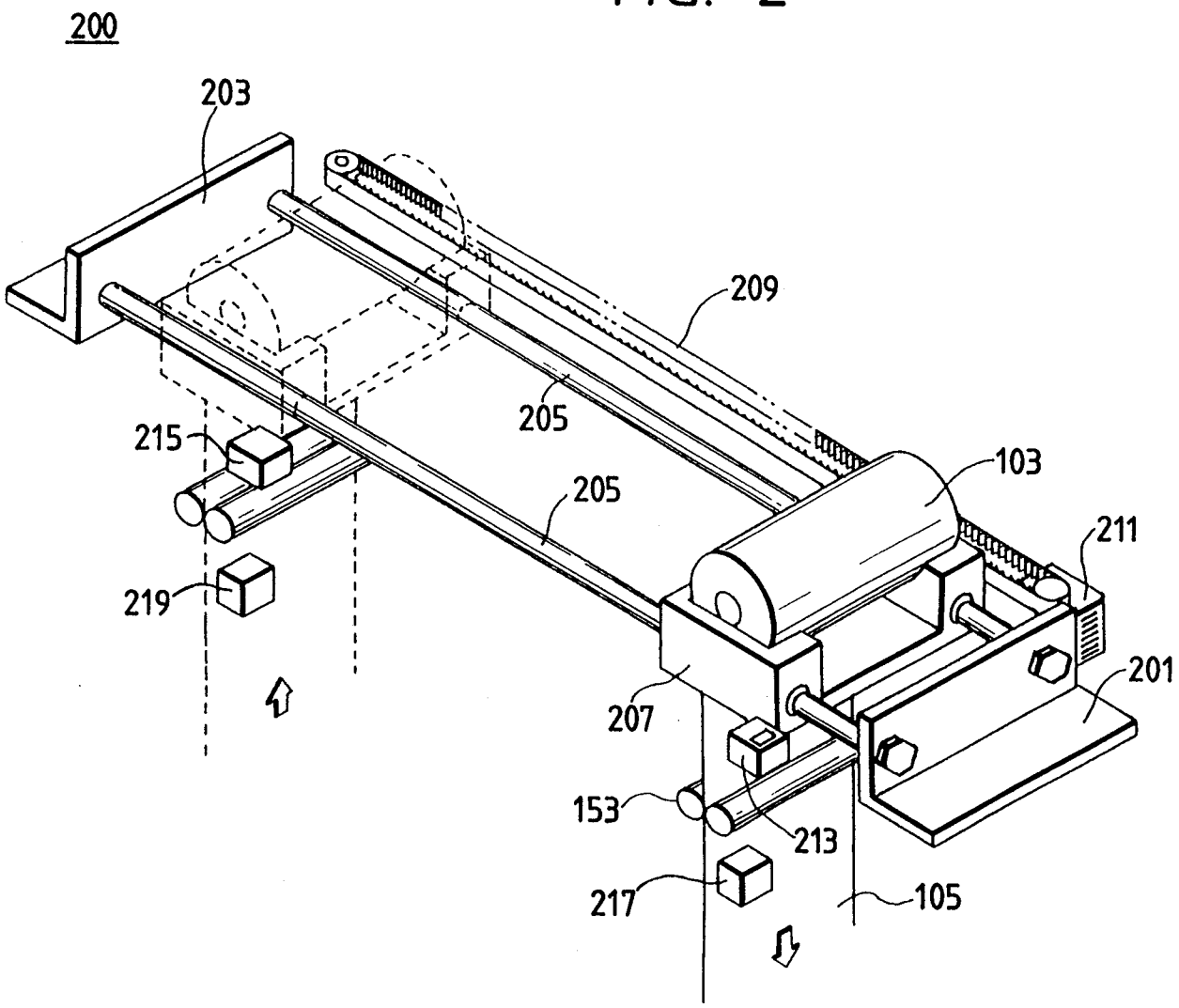
FIG. 2 is a perspective view of a cartridge transferring section 200 shown in FIG. 1.

The cartridge transferring section 200 will be described with reference to FIG. 2. The section 200 comprises: rails 205 laid over rail supporting members 201 and 203 which determine a conveyance start position (indicated by the real lines in FIG. 2) and a conveyance end position (indicated by the dotted lines in FIG. 2), respectively; a base 207 in which the cartridge 103 is loaded; and an electric motor 211 which drives an endless belt 209 coupled to the base 207, to move the latter 107 back and forth along the rails 205.

Sensors 213 and 215 are provided at the conveyance start position and the conveyance end position, respectively, to detect the presence or absence of the base 207 there. In addition, sensors 217 and 219 for detecting the film 105 are provided along the film conveyance path near the conveyance start position and the conveyance end position, respectively.

Figure 3:
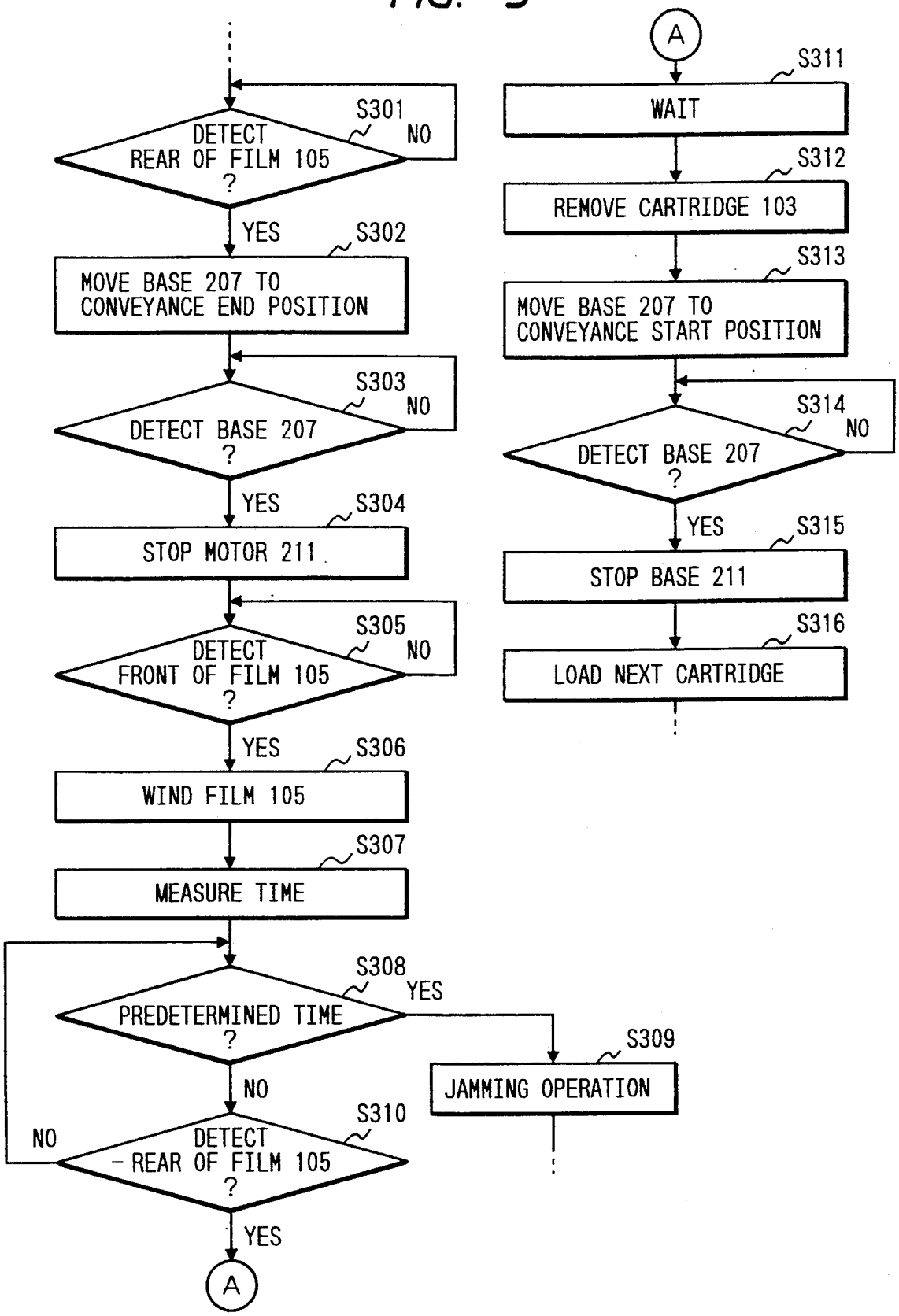
FIG. 3 is a flow chart for a description of the operation of the cartridge transferring section 200.

The operation of the cartridge transferring section 200 will be described with reference to FIG. 3.

The pair of conveying rollers are driven to pull the film 105 out of the cartridge 103 loaded in the base 207. When the rear end of the film thus pulled out is detected by the sensor 217 (Step S301, YES), the motor 211 is driven to move the base 207 to the conveyance end position (Step S302).

When the base 207 at the conveyance end position is detected by the sensor 215 (Step S303, YES), the motor 211 is stopped (Step S304).

When the top end of the film 105 thus conveyed is detected by the sensor 219 (Step S303, YES), the film is wound in the cartridge 103 loaded in the base 207 held at the conveyance end position (S306). Thereafter, in order to detect whether or not jamming occurs with the film 105 being conveyed, a jamming timer is started to measure the lapse of winding time of the film (S307).

When the conveyance time reaches a predetermined value corresponding to an estimated time for winding (Step S308, YES), it is determined that jamming has occurred with the film, and the jamming is suitably dealt with (Step S309). When the tail end of the film 105 being wound is detected before the conveyance time measured reaches the predetermined value (Step S308, NO), then after the lapse of a predetermined period of time the cartridge 103 in which the film 105 has been wound is unloaded from the base 207 (Step S312). When the cartridge 103 is unloaded from the base 207, the motor 211 is turned in the opposite direction, so that the base is moved to the conveyance start position (Step S313).

When the base 207 at the conveyance start position is detected by the sensor 213 (Step S314, YES), the motor 211 is stopped (Step S315). Thereafter, the next cartridge is loaded (Step S316), and the operations of Steps 301 through 315 are performed all over again.

Figure 4:
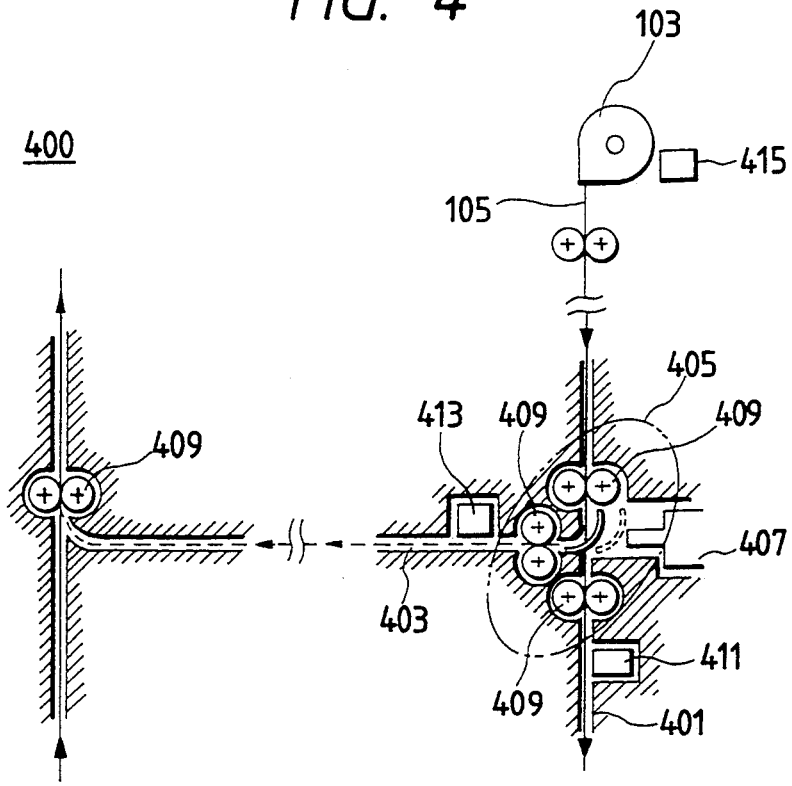
FIG. 4 is a front view of a bypass section 400 shown in FIG. 1.

The bypass section 400 will be described with reference to FIG. 4.

The bypass section 400 has a branching region 405 which operates to lead the film 105 to one conveying path 401 which is extended to the processing tank 107, or to another conveying path 403 which is extended directly to the negative film exposing section 121. A solenoid 407 arranged at the branching region 405 is driven to select one of the conveying paths 401 and 403.

The solenoid 407 is operated as follows: A sensor 415 provided near the conveyance start position where the cartridge 103 loaded in the base is positioned detects whether or not the cartridge has indicating means, such as a pawl, which indicates whether or not the film in the cartridge has been developed when the film has been developed, the pawl is removed from the cartridge; whereas when not developed, the pawl is not removed. That is, the solenoid 407 is operated according to the results of detection.

The indicating means may be a hole instead of the pawl. In this case, it is detected whether or not the hole is present.

Pairs of conveying rollers 409 are arranged at predetermined positions to convey the film 105 along the selected one of the conveying paths.

Sensors 411 and 413 are provided along the conveying paths 401 and 403 near the branching region 405, to detect the film 105.

Figure 5:
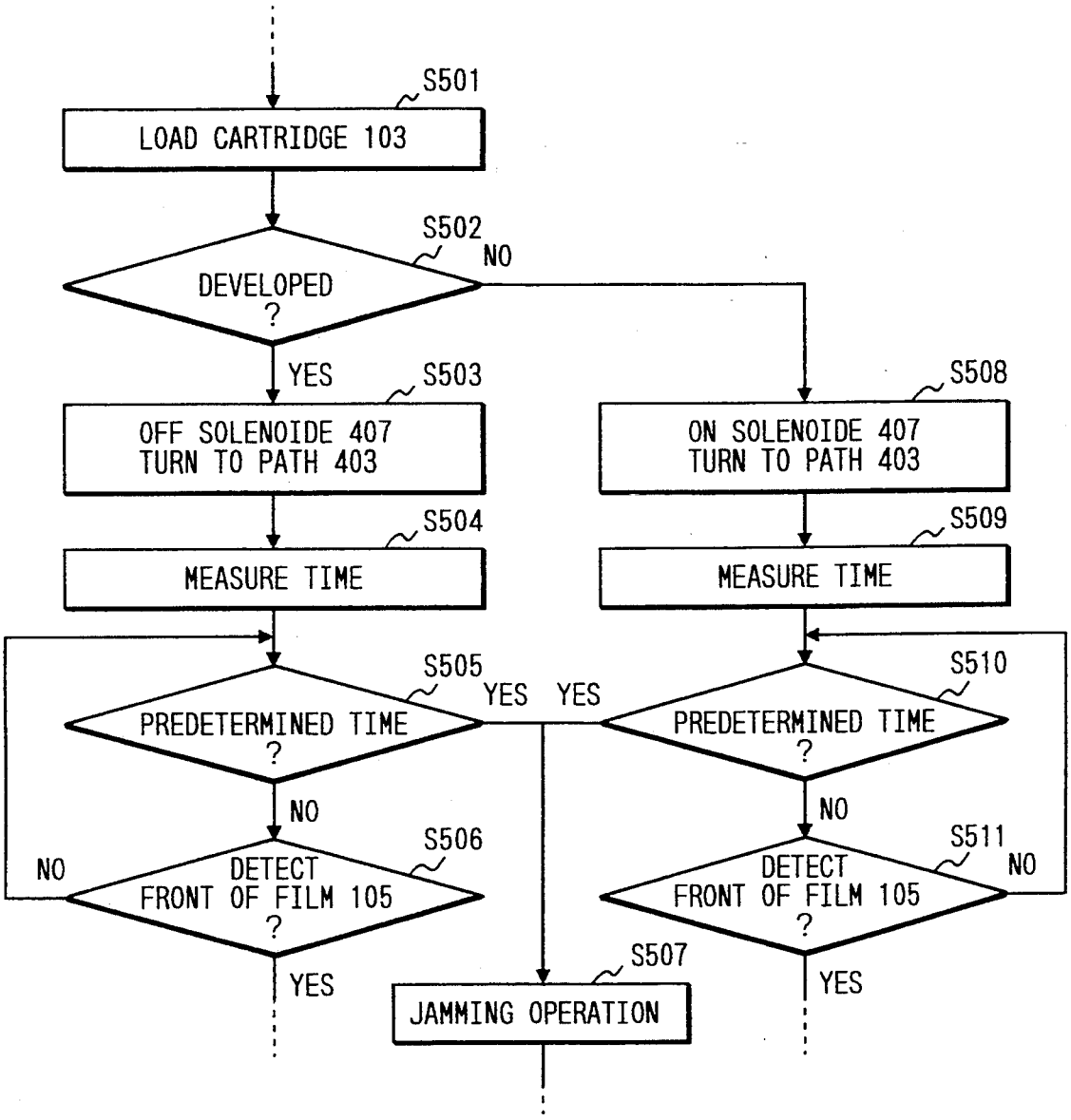
FIG. 5 is a flow chart for a description of the operation of the bypass section 400.

The operation of the bypass section 400 will be described with reference to FIG. 5.

When a cartridge 103 is loaded in the base 207 at the conveyance start position (Step S501), it is detected by the sensor 415 whether or not the film in the cartridge has been developed (Step S502).

When it is determined that the film has been developed (Step S502, YES), the solenoid 407 is deenergized to select the conveying path 403 (Step S503). Thereafter, in order to detect whether or not jamming occurs with the film, the jamming timer is operated to measure the lapse of conveyance time from the deenergized timing (Step S504). That is, the jamming of the film at the selecting section can be detected by measuring the conveyance time.

When the above conveyance time reaches a predetermined value (Step S505, YES), it is determined that jamming has occurred with the film, and the jamming is suitably dealt with (Step S507). When the front end of the film 105 is detected by the sensor 413 (Step S506, YES) before the conveyance time reaches the predetermined value (Step S505, NO), the pair of conveying rollers 409 are driven to continue the conveyance of the film 105.

When it is determined that the film has not been developed yet (Step S502, NO), the solenoid 407 is energized to select the conveying path 401 (Step S508). Thereafter, in order to detect whether or not the film suffers from jamming, the jamming timer is operated to measure the lapse of conveyance time from the selecting operation (Step S509).

When it is detected with the jamming timer that the above conveyance time has reached the predetermined value (Step S510, YES), it is determined that jamming has occurred with the film, and the jamming is suitably dealt with (Step S507). When the top end of the film 105 is detected by the sensor 411 (Step S510, YES) before the conveyance time reaches the predetermined value (Step S510, NO), the pair of conveying rollers 409 are driven to continue the conveyance of the film 105.

Figure 6:
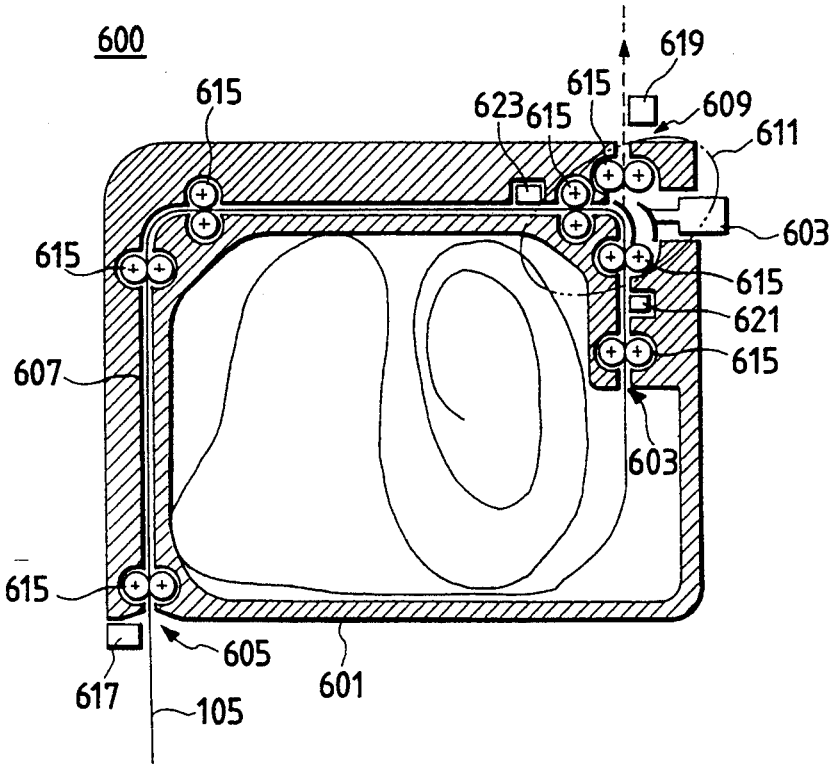
FIG. 6 is a front view of an inverting section 600 shown in FIG. 1.

The inverting section 600 will be described with reference to FIG. 6.

The inverting section 600 comprises: a box 601 for accommodating the film 105; an opening 603 formed in the box 601; an inlet 605 through which the film 105 is led into the box; a conveying path 607 formed in the walls of the box in such a manner that it is extended between the opening 603 and the inlet 605; an outlet 609 through which the film is pulled out; and a branching region 611 where the film is allowed to leave the conveying path and pulled out through the outlet 609; and a solenoid 613 which is driven to provide a conveying path for the film 105.

Pairs of conveying rollers 615 are arranged at predetermined positions, and driven to convey the film 105 along a given conveying path.

Sensors 617 and 619 for detecting the film 105 are provided near the inlet 605 and the outlet 609, respectively. Furthermore, sensors 621 and 623 for detecting the film 105 are provided along the conveying path 607 near the branching region 611.

Figure 7:
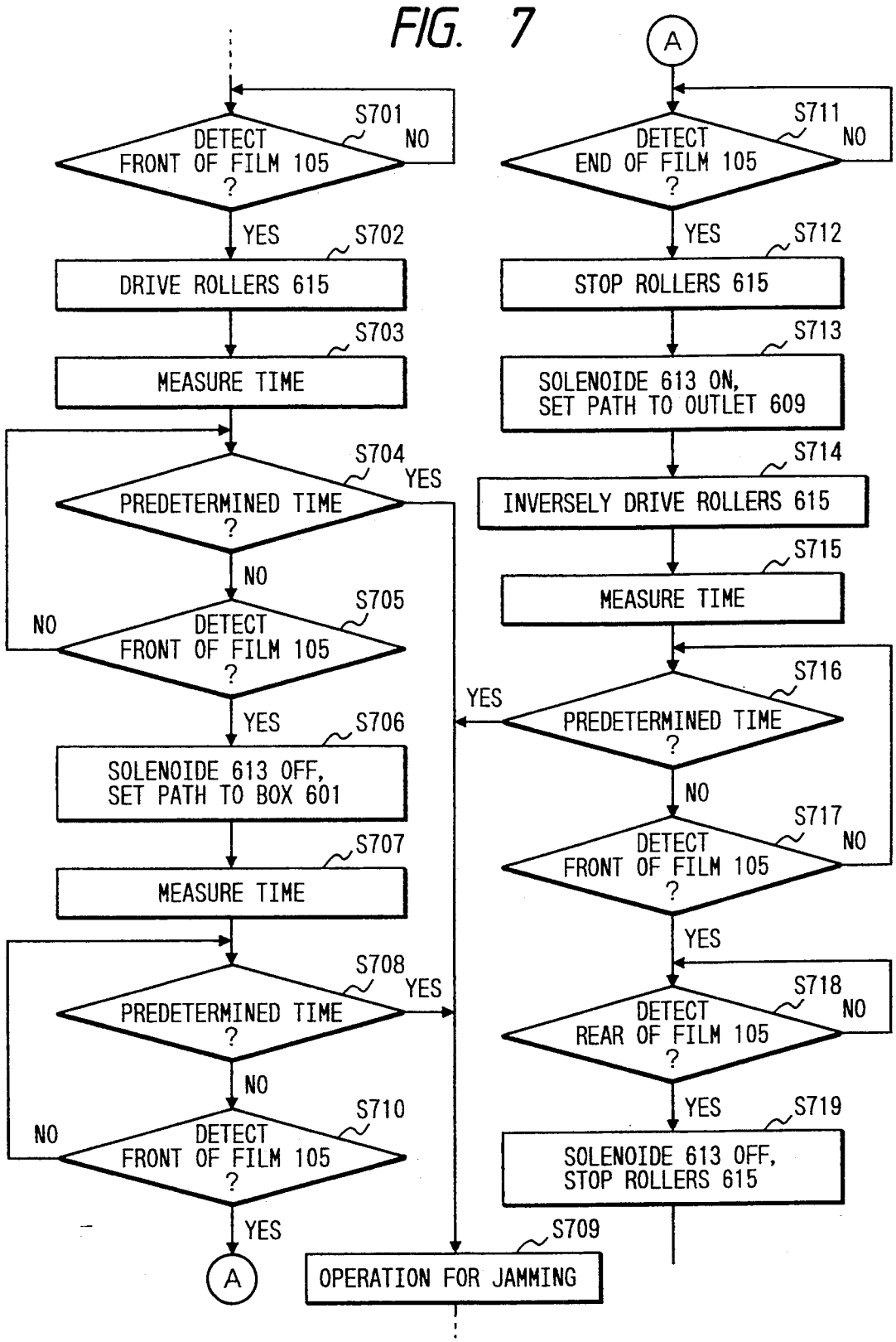
FIG. 7 is a flow chart for a description of the operation of the inverting section 600.

The operation of the inverting section 600 will be described with reference to FIG. 7.

When the sensor 617 detects the front end of the film 105 at the inlet 605 (Step S710, YES), the pair of conveying rollers 615 are driven to draw the film into the box through the inlet 605. Thereafter, the jamming timer is operated to measure the lapse of conveyance time while drawing the film (Step S709).

When it is detected with the jamming timer that the above conveyance time has reached the predetermined value (Step S704, YES), it is determined that jamming has occurred with the film, and the jamming is suitably dealt with (Step S709). When the front end of the film 105 is detected by the sensor 621 (Step S705, YES) before the conveyance time reaches the predetermined value (Step S704, NO), the solenoid 613 is deenergized to provide a conveying path through which the film 105 is led into the box. Thereafter, the jamming timer is started to measure the lapse of conveyance time while leading the film into the box (Step S707).

When it is determined with the jamming timer that the above conveyance time has reached a predetermined value (Step S708, YES), it is determined that jamming has occurred with the film, and the jamming is suitably dealt with (Step S709). When, before the conveyance time reaches the predetermined value (Step S708, NO) the front end of the film 105 is detected by the sensor 623 (Step S710, YES) and further the rear end is also detected (Step S711, YES) the conveying rollers 615 are stopped. Thereafter, the solenoid 613 is energized, to form a conveying path through which the film 105 is taken out through the outlet 609. Upon provision of the conveying path, the conveying rollers 615 are driven in the opposite direction (Step S713). Thereafter, the jamming timer is started to measure the lapse of conveyance time from the film driven in the opposite direction (Step S714).

When it is determined with the jamming timer that the above conveyance time has reached a predetermined value (Step S716, YES), it is determined that jamming has occurred with the film, and the jamming is suitably dealt with (Step S709). When, before the conveyance time reaches the predetermined value (Step S716, NO), the front end of the film 105 is detected by the sensor 619 (Step S717, YES) and further the rear end is also detected (Step S718, YES) the solenoid 613 is deenergized, and conveying rollers 615 are stopped (Step S719).

Example of the arrangement of the bypass section 400 will be described with reference to FIGS. 8(*a*), 8(*b*) and 8(*c*).

In the above-described embodiment shown in FIG. 1, as shown in FIG. 8(*a*) the bypass section 400 is provided before the film developing section 101, the film passed through the bypass section 400 or the film developing section 101 is inverted by the inverting section, and thereafter processed by the negative film exposing section 121, and then put back into its own cartridge 103.

As shown in FIG. 8(*b*), the bypass section 400 may be set immediately after the position where the film 105 is pulled out. In this case, the film is inverted by the inverting section 600, and the frames of the film are exposed successively beginning with the last frame.

In the case of FIG. 8(*c*), no bypass section 400 is provided, and the cartridge conveying section 200 is employed as bypass means, so that when the cartridge 103 having the developed film 105 is loaded in the base, the base is conveyed to the conveyance end position. And at the conveyance end position, the negative film 105 is pulled out of the cartridge but it is not separated from the cartridge 103, that is, the rear end of the film is retained in the cartridge 103. The negative film 105 thus pulled out, while being wound into the cartridge 103, subjected to exposure by the negative film exposing section 121.

The arrangement shown in FIG. 8(*c*) is advantageous in that no bypass section 400 is required, and the negative film 105 pulled out is not separated from the cartridge 103.

Examples of the arrangement of the inverting section 600 will be described with reference to FIGS. 9(*a*), 9(*b*), 9(*c*) and 9(*d*).

In the above-described embodiment, as shown in FIG. 9(*a*) the inverting section 600 is positioned adjacent before the negative film exposing section 121. In this case, the film 105 to be conveyed to the inverting section 600 has been developed already, and therefore the inverting section 600 may be of light chamber type. Furthermore, the negative film 105 is inverted before going into the negative film exposing section 121, and therefore the resultant prints are stacked in the normal order in the print storing section 149.

The inverting section 600 may be positioned adjacent before the film developing section 101 as shown in FIG. 9(*b*). In this case, the prints are stacked in the normal order in the print storing section 149; however, the inverting section 600 must be of dark chamber type because sometimes a photographing film not developed yet is conveyed.

Furthermore, as shown in FIG. 9(*c*), the inverting section 600 may be positioned adjacent after the negative film exposing section 121. In this case, the inverting section may be of light chamber type, and the frames of the film 105 are exposed beginning with the first one, and therefore the resultant films are stacked beginning with the one corresponding to the first frame; that is, they are stacked in the opposite order.

In addition, as shown in FIG. 9(*d*), the inverting section 600 may be set adjacent after the negative film exposing section 121 with the print storing direction of the film storing section 149 inverted. In this case, the prints are stacked in the normal order but upside down.

Those examples of the arrangement of the inverting section 600 may be combined with the examples of the arrangement of the bypass section 400 shown in FIGS. 8(*a*), 8(*b*) and 8(*c*).

Another example of the inverting section 600 will be described with reference to FIG. 10. The inverting section 600 comprises: a box 651 for accommodating the film 105. The box 651 is rotatable having a rotating shaft 653. The box 651 further has an opening 655 through which the film is drawn in and out of the box. The inverting section 600 further comprises a pair of conveying rollers 657 which are driven to draw the film in and out of the box. The box 651 is swingable 180° back and forth around the rotating shaft 653. That is, when the film 105 is to be drawn into the box, the box 651 is swung in one direction so that the opening 655 is set at the position a, and when the film is to be pulled out of the box, the box 651 is swung in the opposite direction so that the opening 655 is set at the position b. A sensor 659 is provided near the opening 655 of the box 651, so that the box 651 is turned when the sensor 659 detects when the film has been taken in the box 651.

The inverting section 600 may be so modified that it has a film winding reel mechanism. In this case, the film wound beginning with the front end is pulled out beginning with the rear end, so that the front and rear ends of the film are swapped.

While the invention has been described with reference to the all-round type photographic processing apparatus having the film developing function, the negative film exposing function, and the paper developing function. However, it should be noted that the technical concept of the invention is applicable to a photographic processing apparatus having the film developing function only, or a photographic processing apparatus having the negative film exposing function, and the paper developing function.

That is, in the case of the photographic processing apparatus having the film developing function only, the inverting section is provided so that the film pulled out is put back in the cartridge as it was, and the bypass section is provide so that, when a cartridge having a developed film is loaded in the base, the cartridge is discharged from the apparatus with the film maintained as it is.

In the case of the photographic processing apparatus having the negative film exposing function, and the paper developing function, the inverting section is provided so that the film pulled out of the cartridge is put back in it as it was, and the bypass section is provide so that, when a cartridge having a developed film is loaded in the base, the cartridge is discharged from the apparatus with the film maintained as it is.

As was described above, the photographic processing apparatus of the invention has the inverting section for swapping the front and rear ends of the film. Therefore, the film pulled out of the cartridge can be put back in it as it was.

Furthermore, in the apparatus of the invention, the conveying path is selected according to whether or not the film has been developed, so that the film which has been developed is not conveyed to the film developing section; that is, it is conveyed directly to the negative film exposing section.

For both the photographic processing apparatus having the film developing function only, and the photographic processing apparatus having the negative film exposing function and the paper developing function, the inverting section may be provided so that the film pulled out of the cartridge is put back in it as it was, and the bypass section may be provided so that, when a cartridge having a developed film is loaded in the base, the cartridge is discharged from the apparatus with the film maintained as it is.

What is claimed is:

1. A photographic processing apparatus for processing an exposed film accommodated in a film accommodating means and a photographic printing paper, comprising:

film conveying means for drawing out said film from said film accommodating means and storing said film in said film accommodating means again, said film being subjected to the processing while said film is conveyed in a conveying passage;

transfer means for moving said film accommodating means from a conveyance start position drawing out said film, to a conveyance end position storing again said film; and conveying passage changing means for changing said conveying passage of said film according to whether or not said film has been developed.

2. The apparatus according to claim 1, wherein said conveying passage changing means includes film inverting means for swapping front and rear ends of said film which is arranged in said conveying passage of said film between said conveyance start position and said conveyance end position, so that said film thus photographically processed is put back in said film accommodating means at said conveyance end position beginning with the rear end thereof.

3. A photographic processing apparatus having developing process for an exposed film accommodated in a film accommodating means, photographic printing paper exposing processes, and photographic printing paper developing process, said apparatus comprising:

film conveying means for drawing out said film from said film accommodating means and storing said film in said film accommodating means again, said film being subjected to said film developing and photographic printing paper exposing processes which said film is conveyed in a conveying passage;

transfer means for moving said film accommodating means from a conveyance start position drawing out said film, to a conveyance end position storing again said film; and conveying passage changing means for changing said conveying passage of said film according to whether or not said film has been developed.

4. The apparatus according to claim 3, wherein said conveying passage changing means includes film inverting means for swapping front and rear ends of said film which is arranged in said conveying passage of said film between said conveyance start position and said conveyance end position, so that said film thus developed is put back in said film accommodating means at said conveyance end position beginning with the rear end thereof.

5. The apparatus according to claim 4, wherein said conveying means includes detecting means provided at said conveyance start position, said detecting means detecting whether or not said film in said film accommodating means has been developed.

6. The apparatus according to claim 5, wherein said conveying means includes branching means for leading, when said detecting means detects that said film in said film accommodating means has been developed, said film directly to said exposing process, and when said film in said film accommodating means has not been developed, said film directly to said developing process.

7. A photographic processing apparatus having developing process for a photographic film accommodated in a film accommodating means, comprising:

film conveying means for drawing out said film from said film accommodating means and storing said film in said film accommodating means again, said film being subjected to said developing process while said film is conveyed in a conveying passage;

transfer means for moving said film accommodating means from a conveyance start position drawing out said film, to a conveyance end position storing again said film;

detecting means, provided at said conveyance start position, for detecting whether or not said film in said film accommodating means has been developed; and removing means, provided in said conveying means, for removing said film accommodating means out of said apparatus, when said detecting means detects that said film in said film accommodating means has been developed.

8. A photographic processing apparatus having exposing process for applying light through a developed film accommodated in a film accommodating means onto a photographic paper, said apparatus comprising:

film conveying means for drawing out said film from said film accommodating means and storing said film in said film accommodating means again, said film being subjected to a developing process while said film is conveyed in a conveying passage;

transfer means for moving said film accommodating means from a conveyance start position drawing out said film, to a conveyance end position storing again said film;

detecting means, provided at said conveyance start position, for detecting whether or not said film in said film accommodating means has been developed; and removing means, provided in said conveying means, for removing said film out of said apparatus, when said detecting means detects that said film in said film accommodating means has not been developed.

* * * * *